US007621797B1

(12) United States Patent
Hershkovich

(10) Patent No.: US 7,621,797 B1
(45) Date of Patent: Nov. 24, 2009

(54) NURSING BRASSIERE

(76) Inventor: Samuel Hershkovich, 291 Arkansas Dr., Brooklyn, NY (US) 11234

( * ) Notice: Subject to any disclaimer, the term of this patent is extended or adjusted under 35 U.S.C. 154(b) by 0 days.

(21) Appl. No.: 12/330,162

(22) Filed: Dec. 8, 2008

(51) Int. Cl.
*A61F 5/44* (2006.01)
*A41C 3/04* (2006.01)

(52) U.S. Cl. ..... 450/36; 604/74; 604/346

(58) Field of Classification Search ..... 450/36–38; 604/73–76, 317, 327, 346, 540; 606/234–236
See application file for complete search history.

(56) References Cited

U.S. PATENT DOCUMENTS

| | | | | | |
|---|---|---|---|---|---|
| 296,609 | A | * | 4/1884 | Pattee | 604/346 |
| 2,044,913 | A | * | 6/1936 | Miller | 473/610 |
| 2,298,361 | A | * | 10/1942 | Freund | 607/108 |
| 3,840,012 | A | * | 10/1974 | Rushton, Jr. | 604/346 |
| 4,270,538 | A | * | 6/1981 | Murphy | 604/346 |
| 4,756,274 | A | | 7/1988 | Rubino | |
| D357,877 | S | | 5/1995 | Johannesson et al. | |
| 5,827,191 | A | | 10/1998 | Rosenfeld | |
| 5,971,952 | A | * | 10/1999 | Medo | 604/74 |
| 5,993,479 | A | * | 11/1999 | Prentiss | 606/236 |
| 6,109,100 | A | * | 8/2000 | Buckley et al. | 73/198 |
| 6,273,868 | B1 | * | 8/2001 | Nordvik | 604/74 |
| 7,351,251 | B2 | * | 4/2008 | Garrett | 606/236 |
| 7,472,797 | B2 | * | 1/2009 | Ostrowski | 215/306 |

* cited by examiner

*Primary Examiner*—Gloria Hale
(74) *Attorney, Agent, or Firm*—Crossley Patent Law; Mark A. Crossley

(57) ABSTRACT

A nursing brassiere having two identical cups into which a user's natural breast nipples are removably inserted, each cup having a centered aperture removably engaging an artificial nipple having a flow meter assembly therein. The flow meter assembly provides a pegged wheel with pegs extending from the perimeter and a counter. Each time an infant consumes milk through an artificial nipple, the milk flow contact with the pegs turns the wheel which activates the counter to count the number of wheel turns. The counter operationally wirelessly communicates with a remote central processing unit which stores the number of wheel turns for each breastfeeding session and determines and displays the volume of milk. A reset button restarts the count of the number of wheel turns.

6 Claims, 3 Drawing Sheets

NURSING BRASSIERE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

FIELD OF THE INVENTION

The present invention relates to a brassiere and, more specifically, a nursing brassiere designed to provide nipple protection against discomfort associated with breastfeeding.

BACKGROUND OF THE INVENTION

A variety of nursing brassieres and milk consumption monitoring devices are provided by prior art patents. For example, one prior art patent teaches a method and device for monitoring milk volume during breastfeeding in which an elastic nipple-shaped cover applied over a nipple area of a woman's breast with holes in the cover positioned above the nipple area for passage of milk to the baby's mouth, having a micro measurement volume sensor located in a space between the nipple and the elastic cover holes to measure the volume of milk flowing therethrough. In the prior art, there is also a device and method for determining milk volume extracted from a breast during a breastfeeding session. Another prior art device teaches an optical milk flow detector. Still another patent teaches a system for detecting a milk surge in a mother's breast which has a breast pump with a breast shield for expressing milk from the breast, a collecting container for receiving the milk expressed and a unit by means of which a quantity of milk received in the collecting container is determined as a function of time. However, what is needed is a device for measuring the volume of milk aspirated from a breast by a feeding infant which includes a flow meter assembly to count every time an infant imparts a sucking force thereon, thereby gauging the amount of milk consumed.

SUMMARY OF THE INVENTION

The present nursing brassiere concerns that of a new and improved nursing brassiere to gauge the amount of milk consumed by a breastfeeding infant. The brassiere includes two breast cups comprising a left cup and a right cup identical to the left cup, which fit over a left breast and a right breast, respectively, when the brassiere is worn and a connection portion between the left cup and the right cup. The present nursing brassiere has an aperture in the center of each cup to expose an artificial nipple into which a breastfeeding user slips each of her natural breast nipples. Engagement means are provided to attach the artificial nipple to the brassiere. The unitary artificial nipple is semi-flexible plastic and has a circular base portion and an extension portion protruding from the center of the base portion. The extension portion has forward portion which has a drinking slit allowing an infant to obtain milk through the artificial nipple from the breast without directly contacting the breast, thereby eliminating chapping, bruising, bleeding or tender nipples. A flow meter assembly is disposed within the extension portion of the nipple. The flow meter assembly provides a pegged wheel having a perimeter from which a plurality of equidistantly spaced apart pegs protrude outwardly and also provides a counter in operational communication with the wheel, a wireless transmitter operationally engaging the counter and wiring. A central processing unit, having a liquid crystal display and a reset button, is in operational communication with a receiver and with a power source controlled by an on/off switch, and is disposed in the brassiere connection portion. Each time an infant consumes milk through each artificial nipple 40, milk flows through and causes the wheel to turn and the counter to transmit the count to a CPU having a display, which displays the volume of milk consumed by the infant during the breastfeeding session. The reset button allows the user to restart the process of measuring the volume of milk consumed by the infant.

The present nursing brassiere also serves to allow the breasts to be easily and conveniently express milk into an artificial nipple to determine the volume of milk consumed by an infant during a breastfeeding session, while also supporting the breasts thereby preventing the breasts from sagging, enabling milk ducts to retain their proper position for breastfeeding. The present nursing brassiere may be used by a woman whose baby has started to teethe or bites frequently during the nursing process. Thus, the present device may encourage breastfeeding for a longer period of time than would be the case if a nursing mother's breasts were chapped, bleeding, bruised or tender or if a baby was biting, thereby allowing nursing infants to receive additional health benefits associated with breastfeeding over a longer period of time. The present nursing brassiere is washable and reusable.

The present nursing brassiere is easily and efficiently manufactured and marketed, is of durable and reliable construction, and is economically affordable and available for relevant market segment of the purchasing public.

Thus been outlined, rather broadly, the more important features of a nursing brassiere that the detailed description thereof that follows may be better understood and in order that the present contribution to the art may be better appreciated. There are, of course, additional features of the nursing brassiere that will be described hereinafter and which will form the subject matter of the claims appended hereto.

In this respect, before explaining at least one embodiment of the nursing brassiere in detail, it is to be understood that the nursing brassiere is not limited in its application to the details of construction and to the arrangements of the components set forth in the following description or illustrated in the drawings. The nursing brassiere is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present nursing brassiere. It is important, therefore, that the claims be regarded as including such equivalent constructions insofar as they do not depart from the spirit and scope of the present invention.

An object of the present nursing brassiere is to determine and display the volume of milk consumed by an infant during a breastfeeding session.

Another object of the present nursing brassiere is to eliminate discomfort associated with breastfeeding as a result of chapped, bleeding, bruised or tender nipples.

Still another object of the present nursing brassiere is to protect a nursing mother from being bitten by a teething infant or infant who bites frequently during breastfeeding.

Yet another object of the present nursing brassiere is to support a nursing woman's breasts to prevent sagging breasts, thereby keeping nipples in proper position for nursing.

Still yet another object of the present nursing brassiere is to provide a re-usable and washable nursing brassiere.

It is therefore even yet another object of the present invention to provide a nursing brassiere which has all of the advantages of the prior art and none of the disadvantages.

It is a further object of the present invention to provide a nursing brassiere which may be easily and efficiently manufactured and marketed.

It is an even further object of the present invention to provide a nursing brassiere which is of durable and reliable construction.

It is a still even further object of the present invention to provide a nursing brassiere which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
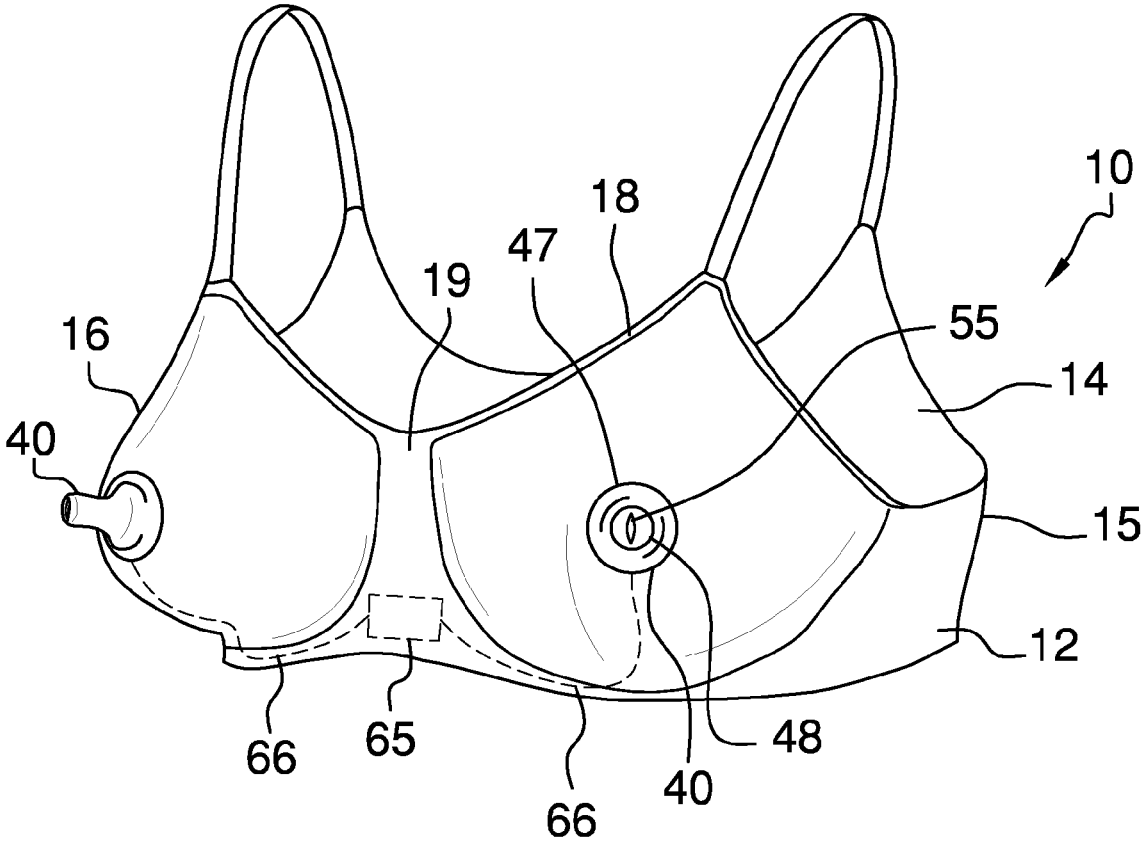
FIG. 1 is a front perspective view of the present nursing brassiere.
Figure 2:
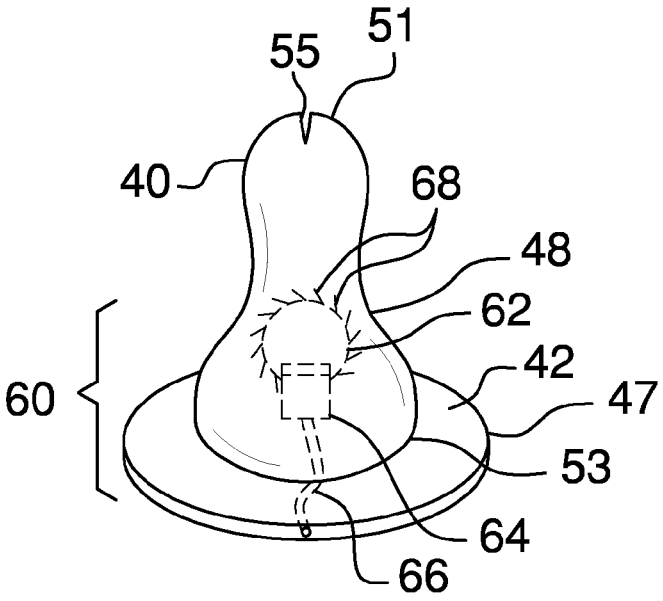
FIG. 2 is a front perspective view of a nipple.
Figure 3:
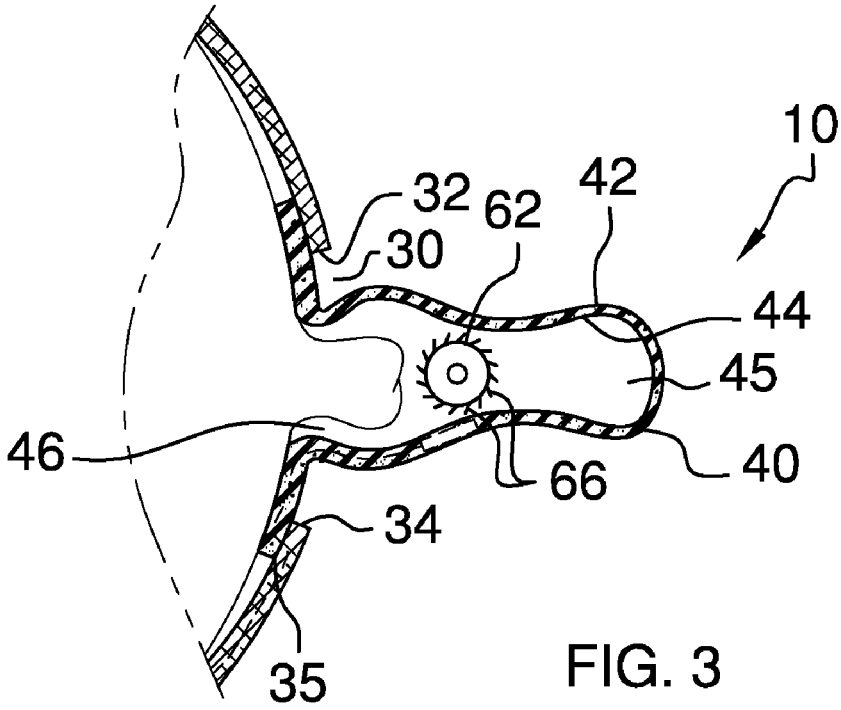
FIG. 3 is a partial side elevation view illustrating a wheel counter within a nipple.
Figure 4:
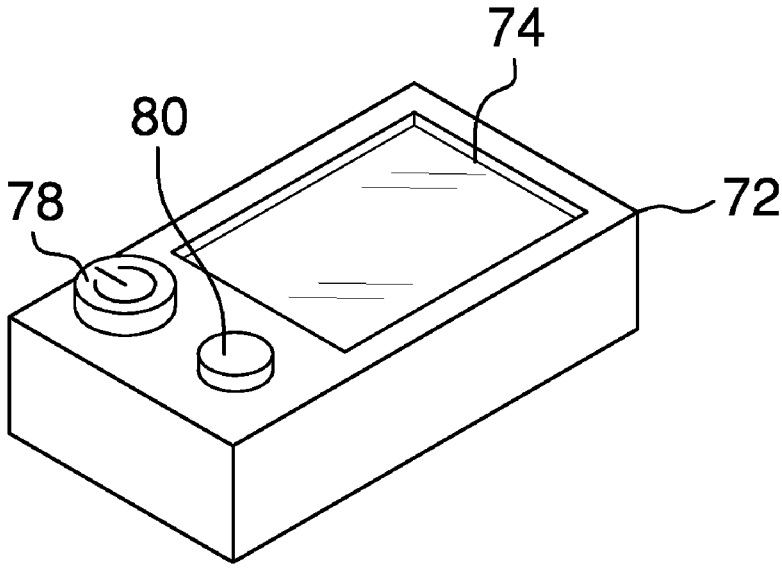
FIG. 4 is a front perspective view of a receiver.
Figure 5:
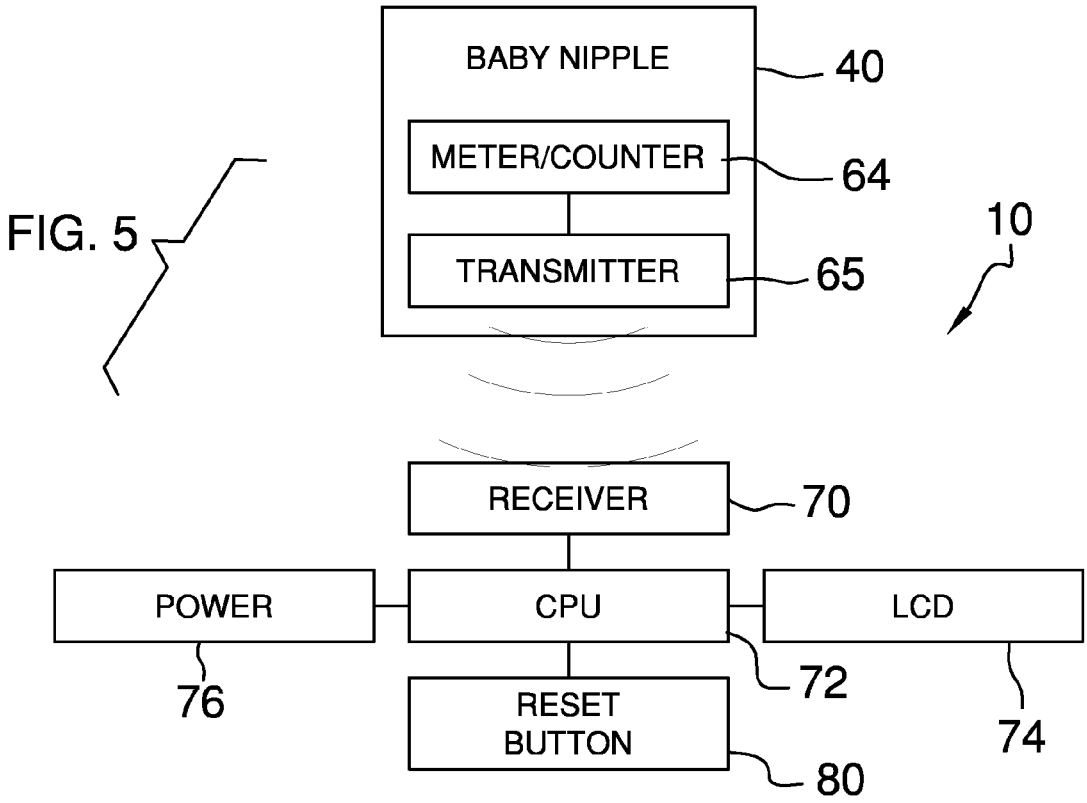
FIG. 5 is a block diagram of the operation of an embodiment providing wireless communication between a transmitter and a receiver.
Figure 6:
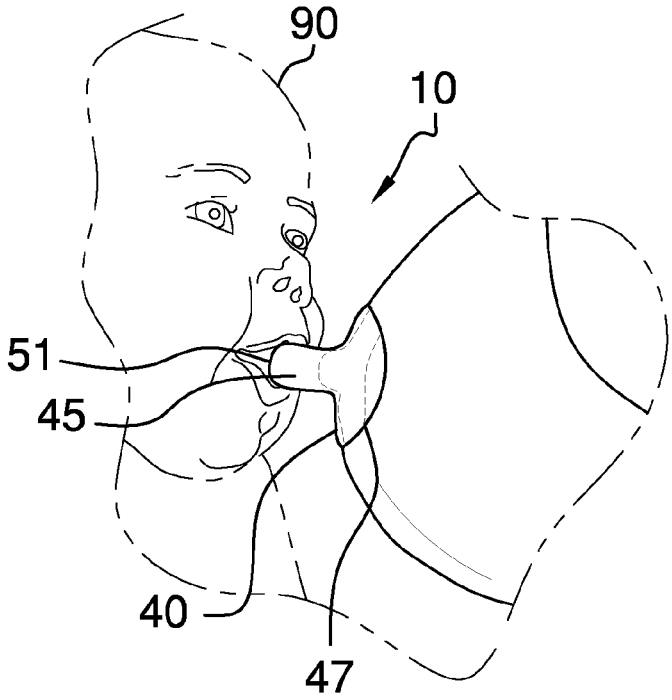
FIG. 6 is an in-use side perspective view.

With reference now to the drawings, and in particular to FIGS. 1 through 6 thereof, a new nursing brassiere embodying the principles and concepts of the present invention and generally designated by the reference numeral 10 will be described.

As best illustrated in FIGS. 1 through 6, the present nursing brassiere 10 provides a brassiere 15 which has an exterior side 12 and an interior side 14 and includes a pair of identical cups comprising a right cup 16 and a left cup 18, as well as a connection portion 19 between the right cup 16 and the left cup 18. When the nursing brassiere 10 is being worn, the right cup 16 is fits over a right breast, while the left cup 18 fits over a left breast.

Each cup 16, 18 of the brassiere 15 has an aperture 30 through the center of each cup 16, 18. Each aperture 30 has a first side 32 and a second side 34. A hollow semi-flexible unitary artificial nipple 40 removably engages each cup 16, 18 through the aperture 30 for breastfeeding. Each nipple 40 may be formed of non-toxic plastic or other similar non-toxic semi-flexible material.

Each nipple 40 has an exterior wall 42 and an interior wall 44. The nipple also has a circular base portion 47 having a center opening 46, an extension portion 48 protruding outwardly from the base portion 47, and an interior portion 45 defined by the interior wall 44 of the base portion 47 and the extension portion 48. The extension portion 48 has a forward end 51 and a rearward end 53, the rearward end 53 conjoined with the base portion 47. The forward end 51 of the extension portion 48 has a drinking slit 55 therethrough. The drinking slit 55 in the extension portion 70 allows an infant to obtain milk from the breast through the interior portion 45 of the nipple 40. A flow meter assembly 60 is disposed within the extension portion 48 of the nipple 40. The flow meter assembly 60 provides a circular pegged wheel 62, a counter 64 in operational communication with the wheel 62, and a length of wiring 66. A plurality of equidistantly spaced apart pegs 68 extend outwardly from the perimeter of the wheel 62. The wheel 62 turns as milk flows and makes contact with the pegs 68 on the wheel 62 and activates the counter 64 which counts the number of wheel 62 turns. The counter 64 operationally engages a wireless transmitter 65 disposed in the connection portion 19 of the brassiere 15 via the wiring 66 to transmit the number of wheel turns to a remote receiver 70, which transmits the number of wheel turns to a remote central processing unit 72 which stores the number of wheel turns and determines the volume of milk consumed by an infant in a breastfeeding session. The central processing unit has a display 74. The display 74 may be a liquid crystal display. The display 74 displays the volume of milk consumed by an infant in a breastfeeding session. A reset button 80 in operational communication with the CPU restarts the count of the number of wheel turns stored on the CPU and the volume of milk consumed by an infant.

Each time an infant sucks milk through each nipple 40 interior portion 45, the milk flows over the pegs 68 and turns the wheel 62. Each turn of the wheel 62 turns the counter 64 which, in turn, transmits the number of turns to the CPU via the wireless transmitter 65 to the receiver 70. The CPU receives stores, and processes the number of wheel turns transmitted to the CPU 72 and determines and displays the volume of milk consumed by an infant in a breastfeeding session.

An engagement means 35 is disposed on the interior side 14 of the first and second sides 32, 34 of each cup 16, 18 aperture 30 and on the exterior wall 42 of each nipple 40 base portion 47 to removably attach each nipple 40 base portion 47 to the brassiere 15. The engagement means 35 may be interconnecting hook and loop fasteners as shown or other implements, including male and female interconnecting snap portions, for interconnecting the brassiere 15 interior side 14 of the first and second sides 32, 34 of each aperture 30 to the exterior wall 42 of the nipple 40 base portion 47.

In use, the present nursing brassiere 10 serves to allow the breasts to express milk through an artificial nipple 40 to gauge and to display on the LCD the volume of milk consumed by an infant 90 during a breastfeeding session. The breastfeeding user inserts each breast nipple 92 into the artificial nipple 40 of the present nursing brassiere 10, ensures that the reset button has been pressed to restart the count of wheel turns and then breast feeds the infant 90.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A nursing brassiere comprising, in combination:

a brassiere having a right side surface, a left side surface, a right cup, a left cup identical to the right cup, and a connection portion between the right cup and the left cup, each cup having an aperture centered therein, each aperture having a first side and a second side;

a hollow semi-flexible unitary artificial nipple removably engaging each cup aperture, each nipple having an exterior wall and an interior wall, each nipple comprising:

a circular base portion having a center opening;

an extension portion protruding outwardly from the base portion, the extension portion having a forward end and a rearward end, the forward end having a drinking slit therethrough, the rearward end conjoined with the base portion;

an interior portion defined by the interior wall of the base portion and the extension portion; and a flow meter assembly disposed within the extension portion, the flow meter assembly comprising:

a circular pegged wheel having a plurality of equidistantly spaced apart pegs radially extending outwardly from the perimeter of the wheel;

a counter in operational communication with the wheel;

a wireless transmitter operationally engaging the counter;

a length of wiring in communication between the counter and the flow meter;

a receiver disposed in the connection portion, the receiver in operational communication with the transmitter;

a central processing unit disposed in the connection portion, the central processing unit having a display and in operational communication with the receiver and a source of power controlled by an on-off switch; and wherein milk flows through the nipple interior portion and over the pegs thereby turning the wheel whereby the counter is activated and whereby the activated counter selectively transmits a number of wheel turns to the receiver;

wherein the receiver transmits the number of wheel turns to the central processing unit; and wherein the display displays the number of wheel turns whereby a volume of milk consumed by an infant through the nipple is determined.

2. The nursing brassiere of claim 1 further comprising a reset button in operational communication with the central processing unit wherein the reset button restarts the count of the number of wheel turns on the central processing unit.

3. The nursing brassiere of claim 2 wherein the display is a liquid crystal display.

4. The nursing brassiere of claim 3 further comprising an engagement means disposed on the interior side of the first and second sides of each cup aperture and on the exterior wall of each nipple base portion wherein each nipple base portion is removably attached to the brassiere.

5. The nursing brassiere of claim 4 wherein the engagement means is interconnecting hook and loop fasteners.

6. A method of determining a volume of milk consumed by an infant in a breastfeeding session utilizing the nursing brassiere of claim 5 wherein the method comprises:

placing one of the artificial nipples in each cup aperture;

attaching one of the nipple base portion to each of the right cup and left cup;

activating the power source;

pressing the reset button wherein the reset button restarts the count of the number of wheel turns on the central processing unit;

breastfeeding an infant utilizing at least one artificial nipple attached to at least one of the right cup and the left cup, wherein milk flows through the artificial nipple and over the pegs thereby turning the wheel, whereby the counter is activated and whereby the activated counter transmits a number of wheel turns to a receiver, wherein the receiver transmits the number of wheel turns to the central processing unit; and wherein the display displays the number of wheel turns;

reading the display wherein the display shows the number of wheel turns; and measuring a volume of milk consumed by an infant from the number of wheel turns displayed.

* * * * *